US005330152A

United States Patent [19]

Visco

[11] Patent Number: 5,330,152

[45] Date of Patent: Jul. 19, 1994

[54] FLUSH VALVE CHOCK

[76] Inventor: John Visco, 334 Jeffer St., Ridgewood, N.J. 07450

[21] Appl. No.: 91,579

[22] Filed: Jul. 14, 1993

[51] Int. Cl.[5] ..... F16K 35/02; E03D 5/012; E03D 5/08; E03D 11/10

[52] U.S. Cl. ..... 251/89.5; 4/321; 4/323; 4/434; 4/661; 137/240; 251/295

[58] Field of Search ..... 4/321, 323, 378, 434, 4/272, 308, 329, 330, 332, 622, 661; 137/238, 240, ; 251/89.5, 295

[56] References Cited

U.S. PATENT DOCUMENTS

| | | | |
|---|---|---|---|
| 187,545 | 2/1877 | McEwan | 4/434 |
| 358,929 | 3/1887 | Hill et al. | 4/434 |
| 429,518 | 6/1890 | Goetze | 4/434 |
| 964,838 | 7/1910 | Badger | 4/434 |
| 1,800,045 | 4/1931 | Bates | 251/89.5 |
| 2,817,092 | 12/1957 | Hahn | 4/323 |
| 3,129,919 | 4/1964 | Evans | 251/89.5 |
| 3,636,971 | 1/1972 | Hagar | 137/238 |
| 4,145,773 | 3/1979 | Sargent et al. | 4/321 |
| 4,217,668 | 8/1980 | Sargent et al. | 4/321 |
| 4,397,445 | 8/1983 | Burquier | 251/89.5 |
| 4,710,988 | 12/1987 | Stewart | 4/438 |
| 4,974,899 | 12/1990 | Sargent | 4/321 |
| 5,036,554 | 8/1991 | Blount | 4/323 |

*Primary Examiner*—George L. Walton
*Attorney, Agent, or Firm*—Bachman & LaPointe

[57] ABSTRACT

A chock for holding open a valve member of a flush valve assembly of a portable toilet having an outlet for communicating the toilet with a storage tank, the valve member being associated with the outlet and movable between a closed position wherein the valve member blocks the outlet and an open position wherein the outlet is unblocked, and wherein the valve member is biased toward the closed position, the chock including a body member adapted for placement within the outlet so as to hold the valve member in the open position and allow communication between the outlet and the storage tank, and a handle attached to the body member for placing the body member in the outlet and for removing the body member from the outlet.

17 Claims, 3 Drawing Sheets

FLUSH VALVE CHOCK

BACKGROUND OF THE INVENTION

The invention relates to portable toilets and, particularly, to a chock for holding the flush valve of a portable toilet open so as to facilitate the cleaning and servicing of the toilet.

Portable toilets are widely used in numerous applications including recreational vehicles, trucks, temporary installations at work sites, and the like, wherein a limited capacity for waste water is available. Such toilets typically have a flush valve having an outlet and a flap or valve member which closes the outlet. The valve is typically biased into the closed position and opened by depressing a pedal, handle or lever or the like to open the valve. Conventionally, upon the release of such pedal, etc., the valve member returns to the closed position. U.S. Pat. Nos. 4,145,773, 4,217,668, 4,710,988 and 4,974,899 are representative of such conventional portable toilet apparatus.

The water supply for flushing such toilets is typically actuated by the valve member or pedal so that when the pedal is released and the valve member closed, the flow of water into the toilet is stopped. Such a function is useful for obtaining efficient use of a small amount of flush water. However, when the toilet is to be cleaned or the system flushed by running water (either from the system or from an external source such as a hose) through the toilet and into the black water holding tank, the pedal, handle, etc. must be held depressed to keep the valve member open and, in some cases, to continue the flow of water. It would of course be desirable to provide a toilet wherein said cleaning operation can be performed without having to keep a foot or hand on the pedal or handle to keep the flush valve open.

It is therefore the principal object of the present invention to provide an apparatus for placement in the outlet of the portable toilet to hold the flush valve of the portable toilet open to facilitate cleaning.

It is another object of the invention to provide such an apparatus with a handle structure for convenient placement of the apparatus within the outlet and removal therefrom.

It is still another object of the invention to provide such an apparatus having a positioning structure for proper positioning of the apparatus within the outlet.

It is a further object of the invention to provide such an apparatus which is simple and inexpensive to manufacture.

Other objects and advantages will appear hereinbelow.

SUMMARY OF THE INVENTION

The apparatus of the present invention readily attains the foregoing objects and advantages.

The invention relates to a chock for use in holding the flush valve of a conventional portable toilet open during cleaning of the toilet or flushing of the tank of the system.

According to the invention, such a chock is provided for holding open a valve member of a flush valve assembly of a portable toilet having an outlet for communicating the toilet with a storage tank wherein the valve member is associated with the outlet and movable between a closed position wherein the valve member blocks the outlet and an open position wherein the outlet is unblocked, and wherein the valve member is biased toward the closed position. The chock comprises a body member adapted for placement within the outlet so as to hold the valve member in the open or unblocked position and to allow communication between the toilet and the storage tank, and handle means attached to the body member for placing the body member in the outlet and for removing the body member from the outlet.

The body of the chock is preferably a substantially tubular article having open ends and a diameter less than that of the outlet of the flush valve.

The chock preferably has a positioning structure such as a flange having a diameter greater than that of the outlet, the flange radially extending around one end of the chock.

Still further, the handle means may include a cord member attached to the body member at both ends to define a loop shaped handle. The handle may also be provided in the form of a rigid upstanding structure such as, for example, a simple tab structure or an inverted-J-shaped member or hooks defining a finger hold.

BRIEF DESCRIPTION OF THE DRAWINGS

A detailed description of the preferred embodiments of the invention follows, with reference to the attached drawings, wherein.

DETAILED DESCRIPTION

The invention relates to a chock for holding the valve member of a flush valve of a conventional portable toilet open. This is useful when the toilet is to be cleaned or the tank of the portable toilet system is to be filled and/or flushed, because such an operation requires the valve member of such a portable toilet, which is typically biased into a closed position, to be open. Thus, the valve member of the flush valve must be held open by continuously depressing the foot pedal or lever, which operates the flush valve, during the entire cleaning operation. According to the invention, a chock is provided for positioning within the outlet of the toilet to hold the valve member open so that, advantageously, both hands and both feet of the user are free during the cleaning and/or flushing operation.

Figure 1:
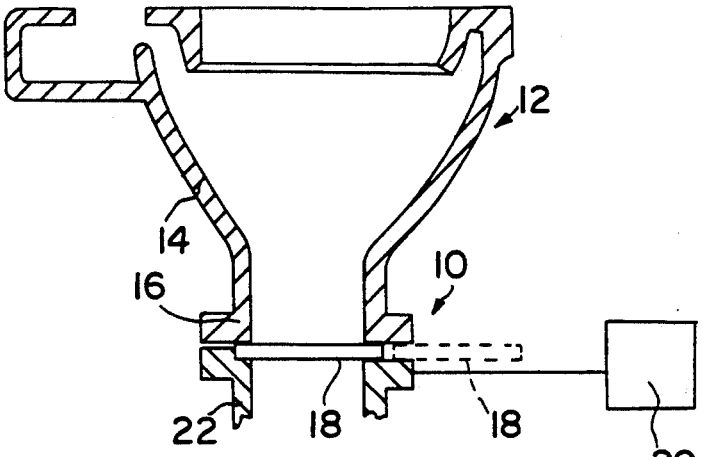
FIG. 1 is a schematic illustration of a typical portable toilet and a flush valve assembly thereof.
Figure 2:
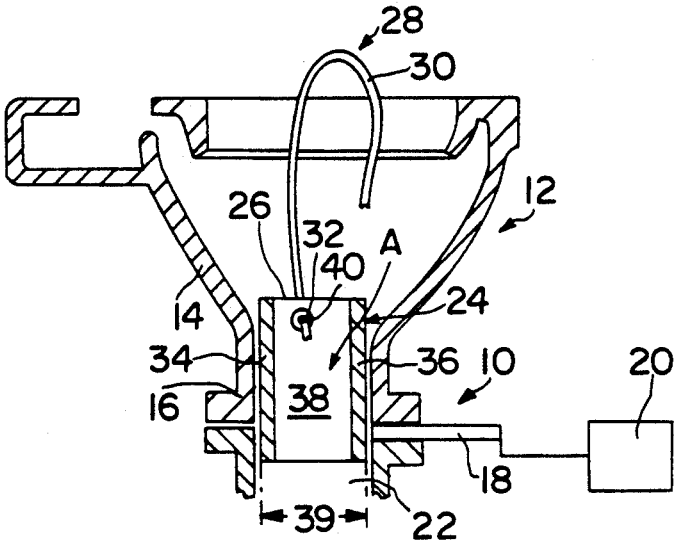
FIG. 2 is a schematic sectional view showing a typical portable toilet with a chock according to the invention disposed in the outlet of the toilet.

FIG. 1 schematically illustrates a typical portable toilet 12 with outlet 16 and flush valve structure 10. Toilet 12 typically includes a bowl portion 14 with outlet 16 for communicating bowl portion 14 with a storage member such as storage tank 22. A Valve member 18 is associated with outlet 16 and is typically positionable between an open position (illustrated by dashed lines in FIG. 1) and a closed position. In the closed position, outlet 16 is blocked by valve member 18, thereby preventing flow through outlet 16. In the open position, valve member 18 is pulled away, either laterally as shown, or pivotally or through any other range of movement as desired so as to remove valve member 18 from sealing engagement with outlet 16 and allow flow through the unblocked outlet 16. Valve member 18 is typically operated by a pedal, handle or lever structure 20 (shown schematically) which serves to open valve member 18. Because valve member 18 is normally closed, it is typically biased toward the closed position by any conventional means (not shown). Such biasing is normally desirable because the valve member should be kept closed unless the toilet is being flushed. However, when bowl portion 14 is to be cleaned, or when it becomes desirable to flush out the entire system for example including waste storage tank 22 (partially shown in FIG. 1 and 2), it is desirable to keep valve member 18 open, against the normal bias, so that a steady stream of water can be introduced into bowl portion 14 and/or tank 22 for cleaning, filling and/or tank flushing purposes.

According to the invention, a chock 24 (FIG. 2) is provided for removable positioning in outlet 16 so as to hold valve member 18 in the open position so as to allow flow from the bowl portion 14 through outlet 16 to storage tank 22. Chock 24 is preferably a hollow tubular structure having open ends 26 so that flow through outlet 16, in this embodiment through chock 24, is allowed when chock 24 is positioned in outlet 16. Chock 24 may suitably be positioned for use by opening valve member 18 with pedal 20, placing chock 24 in outlet 16 so as to extend into the plane occupied by valve member 18 when valve member 18 is in the closed position, and releasing pedal 20. Release of pedal 20 allows valve member 18 to be biased towards the closed position. However, chock 24 blocks valve member 18 and keeps outlet 16 open. The force exerted by valve member 18 on chock 24 is preferably sufficient to maintain chock 24 in position within outlet 16.

Chock 24 also preferably includes a handle member 28 for use in positioning chock 24 in outlet 16 and for removing chock 24 from outlet 16. Handle member 28 may be a cord member 30 attached at each end 32 to chock 24. Cord member 30 may suitably be made from a stiffened material, or coated with a plastic or other substance, so that cord member 30 is substantially rigid. In this manner, cord member 30 is formed into a generally upstanding loop-shaped handle for easy grasping to position or remove chock 24 as desired, and stiffened cord member 30 does not fall down into bowl 14 during use.

Figure 3:
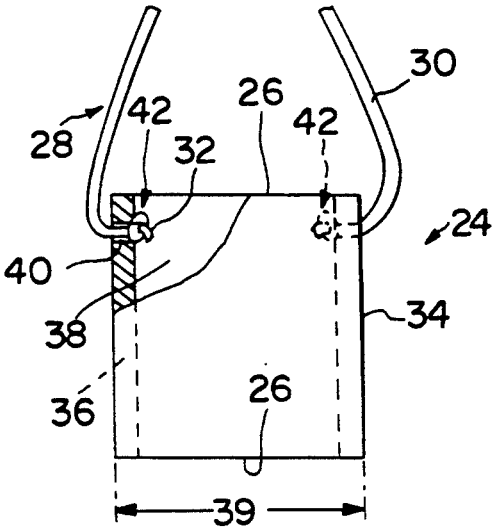
FIG. 3 is a partially sectional side view of a chock according to the invention.

FIG. 3 is a partially broken away view of an embodiment of chock 24 in its simplest form. As shown, chock 24 includes a generally tube shaped article 34 having two open ends 26. Tube shaped article 34 is formed from a tubular wall section 36 which may be extruded or molded or formed in any other suitable and convenient manner. Wall section 36 defines an inner flow passage 38 through which fluids pass when chock 24 is positioned within outlet 16 as shown by arrow A in FIG. 2. Tubular article 34, according to the invention, has a diameter 39 which is less than the diameter of outlets of conventional portable toilets, and may preferably be about $2\frac{3}{8}''$ in outside diameter, so that chock 24 is useful for most or all existing portable toilets.

It should be noted that while the preferred embodiment as discussed above is tubular in shape, such preference is because the tubular article is easily and inexpensively provided. The body portion of chock 24 could, in accordance with the present invention, be any other shaped or adapted body member which, when disposed in outlet 16, serves to hold valve member 18 in the open position and to allow flow from bowl portion 14 to storage tank 22. In this regard, a flow passage may be defined within the body of chock 24, as in tubular article 34, or the flow passage may be defined relying entirely or in part upon the inner wall of outlet 16. An example of such a configuration would be to provide chock 24 with a substantially solid cross section and having one or more longitudinal cutouts (not shown) formed lengthwise along the outer surface of chock 24 so as to define flow passages in conjunction with outlet 16. Chock 24 could similarly have numerous other configurations such as a solid or hollow square or rectangular block or a semi-or part-circular member or the like.

FIG. 3 also illustrates a preferred attachment of cord member 30 to tubular article 34, by providing apertures 40 in the wall 36 of tubular article 34, and by fixing ends 32 of cord member 30 through apertures 40 through any conventional means such as knots 42 or the like.

Figure 4:
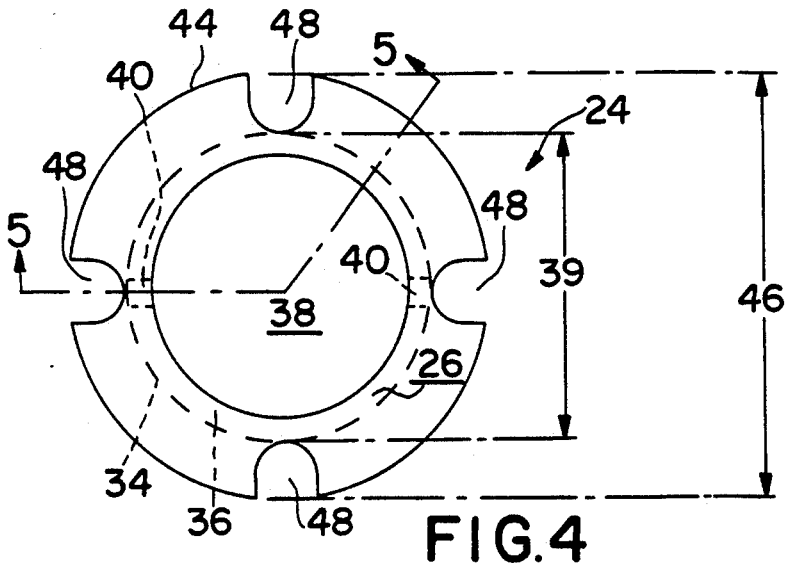
FIG. 4 is an end view of an alternate embodiment of the invention.
Figure 5:
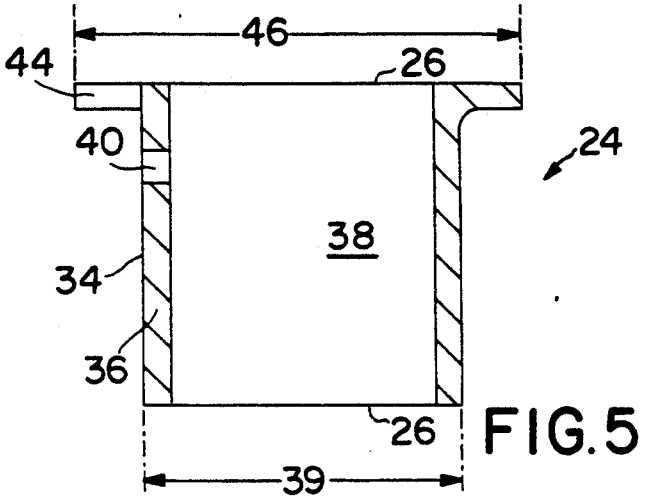
FIG. 5 is a sectional view taken along the lines 5—5 of FIG. 4.

FIGS. 4 and 5 illustrate a preferred embodiment of chock 24 wherein a flange 44 is formed or disposed around an end of tubular article 34. Flange 44 has an outside diameter 46 which is larger than that of outlets 16 of most or all typical portable toilets 12, and serves to hold chock 24 in position and prevent chock 24 from passing through outlet 16. Without such flange, chock 24 is held in position by the force of valve member 18 which is biased toward a closed position and thus pressed against chock 24. With flange 44, however, it is not necessary to rely upon valve member 18 to maintain the desired position of chock 24. This is particularly advantageous in situations where the force of valve member 18 may not be sufficient to hold chock 24 in place. Flange 44 may suitably have an outside diameter 46 of about $3\frac{3}{8}''$, and may suitably be formed on chock 24, or formed separately and attached to chock 24 through any conventional means.

Flange 44 is preferably provided with a number of cutouts 48 spaced about a periphery thereof. Such cutouts 48 serve to define peripheral flow passages around flange 44 and to thereby prevent water or other liquids from collecting on the flat surface of flange 44 during use. Further, cutouts 48 are preferably arranged in alignment with apertures 40 so that cord member 30 is accommodated in cutouts 48 when chock 24 is in use. Otherwise, cord member 30 could be damaged by being caught between flange 44 and the walls of outlet 16 or bowl portion 14.

Figure 6:
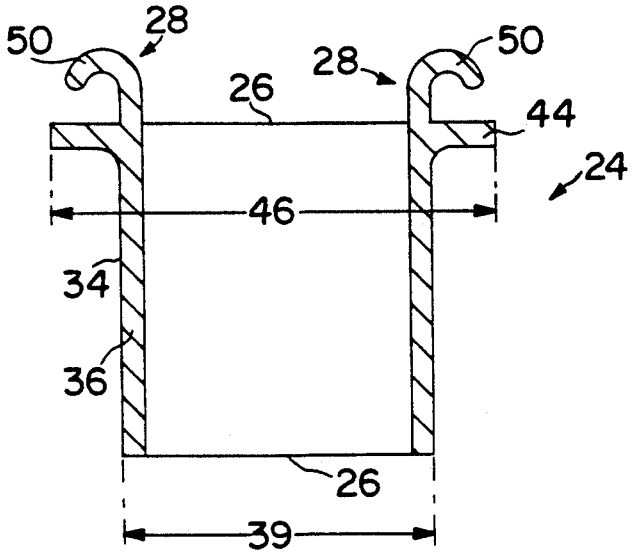
FIG. 6 illustrates an alternate embodiment of the invention.

FIG. 6 illustrates another embodiment of the invention, wherein the handle member includes one or more inverted-J-shaped members formed at an end of chock 24 so as to define upstanding hooks 50. Such hooks 50 serve as finger holds for grasping chock 24 for placement and removal. Such hooks 50 may suitably be formed on chock 24, or formed separately and conventionally attached thereto, as desired.

Figure 7:
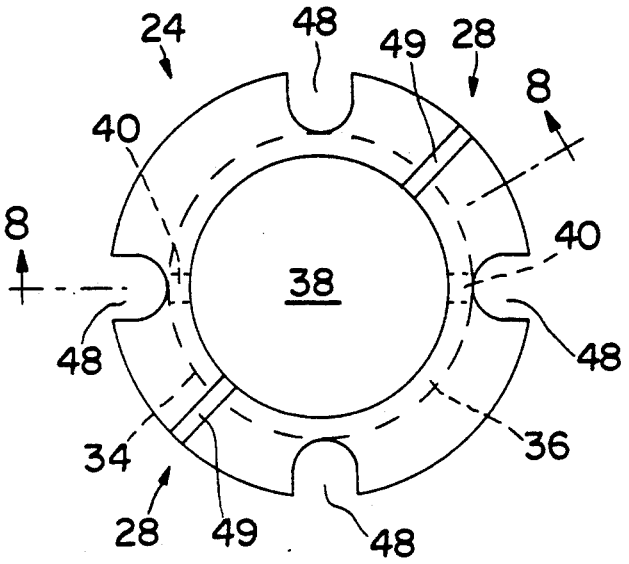
FIG. 7 illustrates an end view of a further alternate embodiment of the invention.
Figure 8:
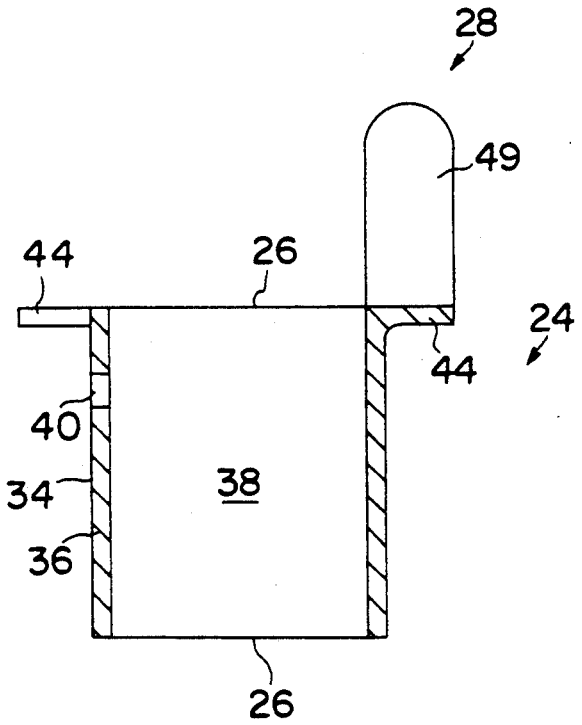
FIG. 8 is a sectional view taken along the lines 8—8 of FIG. 7.

Of course, the handle member may have any of numerous structural configurations in accordance with the present invention. FIGS. 7 and 8 illustrate a further simple embodiment of such a configuration wherein the handle member comprises a simple tab portion 49, extending upwardly from an end 26 of the article, preferably extending from flange 44 as shown. Two such tab portions 49 are illustrated. Of course, one or more tabs 49 may suitably be provided in accordance with the invention. Tab 49, as with flange 44, may be formed or molded as a portion of article 24, or may be provided separately and attached thereto in any conventional manner.

It should be noted that numerous alternate embodiments for the handle structure could of course be used in accordance with the present invention.

Further, chock 24 may be made from plastic, metal, or any other material which is suitable for the desired use and which, preferably, provides a durable and inexpensive article of manufacture.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A chock for holding open a valve member in a flush valve means of a portable toilet having outlet means for communicating the toilet with a storage means, the valve member being associated with the outlet means and movable between a closed position wherein the valve member blocks the outlet means and an open position wherein the outlet means is unblocked, and wherein the valve member is biased toward the closed position, the chock comprising a body member including means for selective placement within the outlet means so as to hold the valve member in the open position and allow fluid communication between the toilet and the storage means, and handle means connected to the body member for placing the body member in the outlet means and for removing the body member from the outlet means.

2. An apparatus according to claim 1, further including positioning means for locating the chock within the outlet means.

3. An apparatus according to claim 2, wherein the positioning means includes a flange disposed around the body member and extending radially to a diameter larger than a diameter of the outlet means, whereby the chock, when positioned in the outlet means, is held in a desired position and prevented from passing through the outlet means.

4. An apparatus according to claim 3, wherein at least one cutout is formed in the flange so as to define at least one peripheral flow passage when the chock is positioned in the outlet means, whereby waste and cleaning liquid are prevented from collecting on the flange.

5. An apparatus according to claim 4, wherein the handle means comprises a cord member attached at both ends to the body member so as to define-a loop-like handle member.

6. An apparatus according to claim 5, wherein the cord member is attached to the body member in positions substantially aligned with the cutouts in the flange of the body member and the cord member passes through the cutouts.

7. An apparatus according to claim 6, wherein the cord member is made form a stiffened material so as to provide an upstanding loop-like handle member.

8. An apparatus according to claim 7, wherein the body member includes at least two apertures formed thereon for attachment of the ends of the cord member.

9. An apparatus according to claim 1, wherein the handle means comprises a cord member attached at both ends to the body member so as to define a loop-like handle member.

10. An apparatus according to claim 9, wherein the cord member is made from a stiffened material so as to provide an upstanding loop-like handle member.

11. An apparatus according to claim 10, wherein the body member includes at least two apertures formed thereon for attachment of the ends of the cord member.

12. An apparatus according to claim 1, wherein the handle means comprises at least one substantially rigid upstanding member attached to the body member so as to extend upwardly when the chock is positioned in the outlet means.

13. An apparatus according to claim 12, wherein the rigid upstanding member is a generally flat upstanding tab.

14. An apparatus according to claim 12, wherein the rigid upstanding member includes an inverted-J-shaped member defining a finger hold for grasping the chock for positioning and removing the chock within the outlet means.

15. An apparatus according to claim 1, wherein the body member is a substantially tubular article having open ends and a diameter less than that of the outlet means.

16. An apparatus according to claim 15, wherein the tubular article includes a wall portion defining a flow passage for communicating the toilet with the storage means when the chock is disposed in the outlet means.

17. An apparatus according to claim 1, wherein the body member is adapted so that at least one of the outlet means and the body member define a flow passage for communicating the toilet with the storage means when the chock is disposed in the outlet means.

* * * * *